United States Patent [19]

Casey

[11] 3,964,287

[45] June 22, 1976

[54] APPARATUS FOR FORMING A GROOVE AND BACK-UP DAM FOR WELDS

[75] Inventor: Thomas P. Casey, Burlington, Iowa

[73] Assignee: Caterpillar Tractor Co., Peoria, Ill.

[22] Filed: Feb. 28, 1975

[21] Appl. No.: 554,247

Related U.S. Application Data

[62] Division of Ser. No. 469,337, May 13, 1974, Pat. No. 3,921,728.

[52] U.S. Cl. ..... 72/210; 83/5; 228/166; 228/15.1; 72/214

[51] Int. Cl.[2] ..... B21D 13/04; B23K 31/02

[58] Field of Search ..... 72/180, 112, 125, 210–; 83/5, 6; 228/166, 165, 15.1

[56] References Cited

UNITED STATES PATENTS

| | | | |
|---|---|---|---|
| 368,374 | 8/1887 | Brown | 72/220 |
| 1,714,108 | 5/1929 | Schlafly | 72/214 X |
| 1,744,549 | 1/1930 | Hopkins | 72/630 Q X |

OTHER PUBLICATIONS

Ross "Chem. Abstract," vol. 67, p. 12856, (1967).

*Primary Examiner*—Milton S. Mehr
*Attorney, Agent, or Firm*—Phillips, Moore, Weissenberger Lempio & Strabala

[57] ABSTRACT

An apparatus for forming an elongated groove and contiguous dam on a member, such as the push plate of a bulldozer blade, comprises a pair of support and guide assemblies defining a space therebetween. The member is fed through the space and a forming roller, rotatably mounted on one of the assemblies, forms the groove and dam on the member.

3 Claims, 4 Drawing Figures

Fig. 3
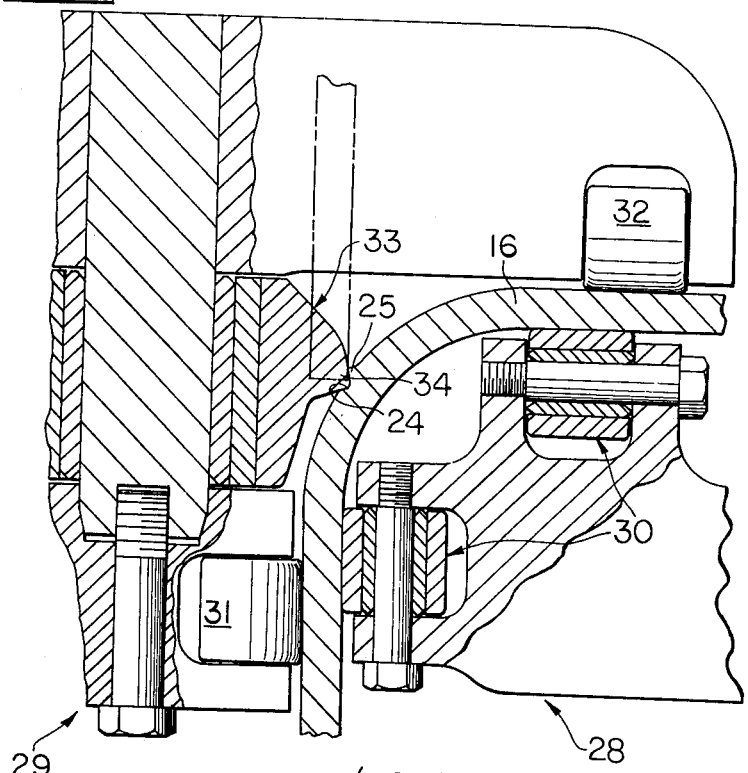
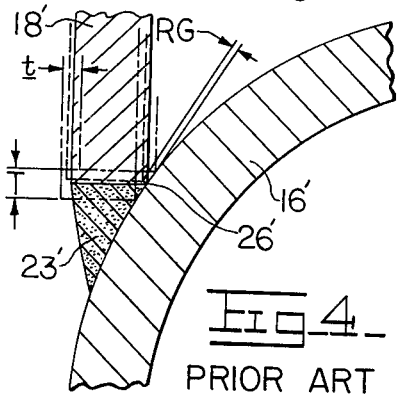
Fig. 4
PRIOR ART

APPARATUS FOR FORMING A GROOVE AND BACK-UP DAM FOR WELDS

CROSS REFERENCE TO RELATED APPLICATION

This application is a divisional of U.S. Patent application Ser. No. 469,337, filed on May 13, 1974 and now U.S. Pat. No. 3,921,728, issued on Nov.

BACKGROUND OF THE INVENTION

Conventional bulldozer blades normally comprise a plurality of overlapped structural members welded onto the back of the push plate thereof to form a strong cellular construction. It has proven difficult to form the backside of such integrated members substantially flat to reduce strees concentrations thereat and to also provide a mounting surface for brackets and the like. The structural members are normally overlapped to back-up the welds which secure the members together. Such a construction oftentimes results in weld "blow-through", primarily due to manufacturing irregularities in the abutting edges of the secured members, which creates a crack thereat to induce premature failure of the integrated structure.

SUMMARY OF THIS INVENTION

An object of this invention is to overcome the above, briefly described problem by providing a structurally sound and economical weldment, particularly adapted for use in work implements such as bulldozer blades, and a method and apparatus for making the same. The weldment comprises a first member having a groove and contiguous dam formed on a surface thereof, a second member having a corner thereof disposed closely adjacent to the groove and dam and common weld means at least substantially filling the groove and securing the members together. The groove and dam are preformed on the first member by a forming roll of an apparatus which further comprises a plurality of support rollers mounted on either side of the member.

BRIEF DESCRIPTION OF THE DRAWINGS

Other objects of this invention will become apparent from the following description and accompanying drawings wherein:

FIG. 3 is a sectional view of an apparatus used to preform a groove and contiguous dam in a structural member employed in such weldment; and FIG. 4 is a cross sectional view similar to FIG. 2, illustrating a prior art weldment.

DETAILED DESCRIPTION

Figure 1:
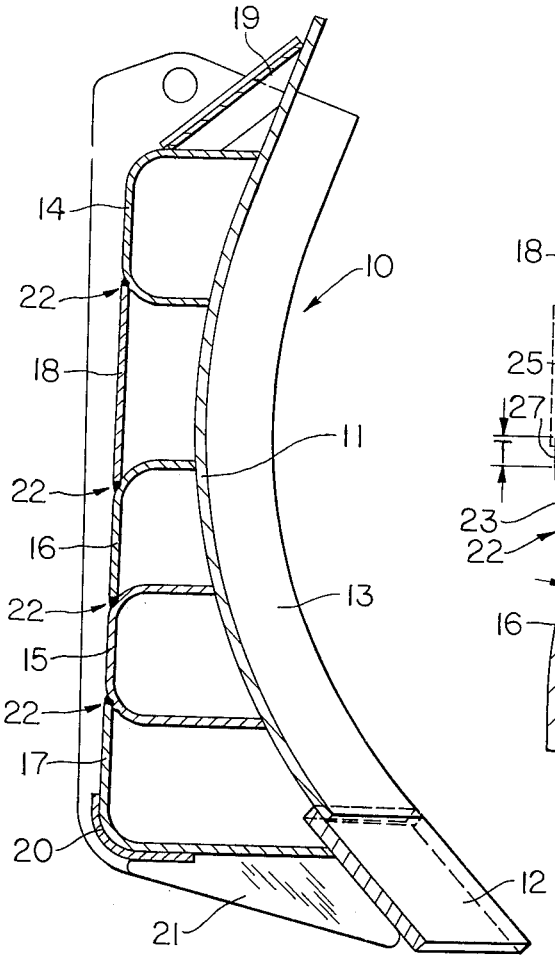
FIG. 1 is a cross sectional view, in elevation, of a bulldozer blade having four weldments of this invention structurally integrated therein.

FIG. 1 discloses a bulldozer blade 10 comprising a push plate 11 having an elongated cutting edge 12 mounted on a lower end thereof and a pair of mold board plates 13 (one shown) secured on opposite, lateral ends thereof. The push plate is structurally reinforced by securing a plurality of metallic members on a back side thereof, including a pair of channel members 14 and 15, a pair of arcuate plate members 16 and 17 and a flat plate member 18. The blade may be further reinforced by plate members 19 and 20 and a plurality of gusset members 21 (one shown).

Figure 2:
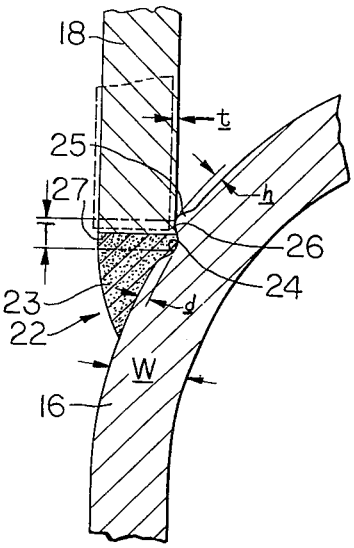
FIG. 2 is an enlarged fragmentary view of one of the weldments.

Members 14–18 are secured together by four substantially identical weldments 22 to facilitate the disposition of the flat back sides of the members substantially coplanar, as shown in FIG. 1. Referring to FIG. 2, each weldment comprises a common weld means 23 securing each pair of adjacent first and second members, such as members 16 and 18, together. First member 16 has a groove 24 of predetermined depth *d* formed on a surface thereof to terminate at one side thereof at a contiguous, raised dam 25 of predetermined height *h*, above such surface.

Second member 18 has a corner 26 thereof preferably disposed within the groove and closely adjacent to the dam. The dam will function to "back-up" the hot weld metal to prevent "blow through" thereof during an arc welding operation. Weld 23 at least substantially fills groove 24 and secures corner 26 and a contiguous bottom flat surface 27 of member 18 to the outer surface of member 16.

In the preferred embodiment of this invention, dimensions *d* and *h* are at least approximately equal. In addition, dimension *d* is preferably selected from the range of from 0.1W to 0.25W, with W constituting the wall thickness of member 16. As further shown in FIG. 2, member 18 can be positioned within manufacturing tolerance ranges *t* and T without affecting the integrity of weld 23.

FIG. 3 illustrates an apparatus and method for preforming groove 24 and dam 25 on the outer arcuate surface of member 16, for example. Such apparatus comprises first and second support and guide assemblies 28 and 29, respectively disposed on either side of member 16. First assembly 28 comprises a pair of first and second support rollers 30, disposed for rotation on axes perpendicular to each other.

Second assembly 29 comprises a like pair of third and fourth guide rollers 31 and 32 disposed for rotation on axes perpendicular to each other. Each of the latter rollers at least partially overlies a respective roller 30. Assembly 29 further comprises a rotary forming roll or die 33, rotatably mounted thereon about an axis parallel to the rotational axis of roller 31.

Rotary forming roll 33 is preferably driven by motor means, not shown, and has an annular cutting edge 34 formed on the periphery thereof. During the preforming operation, cutting edge 34 forms elongated groove 24 and displaces material therefrom upwardly to form dam 25. It should be understood that different sized rollers could be substituted in lieu of roller 33 to vary the size and shape of groove 24 and dam 25.

FIG. 4 illustrates a prior art weldment comprising a first member 16' secured to a second member 18' by an elongated weld 23'. As shown, member 18' has been positioned on the outer arcuate surface of member 16' so that at least a potion of its corner 26' is disposed in line contact therewith. Such disposition represents an ideal disposition for manufacturing purposes wherein a zero root gap RG is provided.

However, even such an ideal match-up would require unduly close manufacturing control during the arc welding operation to prevent "blow through" at gap RG. Furthermore, in actual practice the dimensions of prefabricated members 16' and 18' will normally vary to in turn vary the match-up therebetween within the illustrated manufacturing tolerances *t* and T. Thus, a pronounced root gap RG will exist at various locations between edge 26' and member 16' to permit "blow through" of the weld. Such "blow through" will normally occur even though root gap RG merely constitutes one-sixty-fourth of an inch, for example.

Unless such root gaps are filled or additional structural members are secured between members 16' and 18', prior to placement of the bulldozer blade in the field, structural failures will occur. Field repair of the bulldozer blade, such as by welding a strap or plate across the cracked area, is time consuming and expensive and does not always result in a structurally sound blade construction.

I claim:

1. An apparatus for forming an elongated groove and contiguous dam on the surface of a member comprising a first support and guide assembly, a second support and guide assembly disposed adjacent to and in spaced relationship with respect to said first support and guide assembly to define a space of generally constant thickness to support and guide a formed member of generally constant thickness therebetween, and forming roller means, having an annular cutting edge formed on the periphery thereof, rotatably mounted on one of said first and second support and guide assemblies for forming a groove in and a contiguous dam on a surface of a member.

2. The apparatus of claim 1 wherein each of said first and second support and guide assemblies comprises a pair of rollers rotatably mounted thereon, first and second rollers of said first support and guide assembly partially overlying and spaced apart from third and fourth rollers of said second support and guide assembly, respectively.

3. The apparatus of claim 2 wherein each roller of each pair of said rollers is mounted for rotation on an axis perpendicular to the rotational axis of the other roller of such pair of said rollers and wherein one roller of each pair of said rollers is mounted for rotation on an axis parallel to an axis of rotation of said forming roller.

* * * * *

UNITED STATES PATENT AND TRADEMARK OFFICE

CERTIFICATE OF CORRECTION

PATENT NO. : 3,964,287

DATED : June 22, 1976

INVENTOR(S) : THOMAS P. CASEY

It is certified that error appears in the above-identified patent and that said Letters Patent are hereby corrected as shown below:

Col. 1, under the heading "Cross Reference to Related Application"

the paragraph is incomplete and should end

"...issued on Nov. 25, 1975."

Signed and Sealed this

Twenty-first Day of December 1976

[SEAL]

*Attest:*

RUTH C. MASON
*Attesting Officer*

C. MARSHALL DANN
*Commissioner of Patents and Trademarks*